United States Patent [19]

Turner

[11] Patent Number: 5,064,502

[45] Date of Patent: Nov. 12, 1991

[54] MULTI-PLY WEB FORMER

[75] Inventor: James A. Turner, Lancashire, England

[73] Assignee: Beloit Corporation, Beloit, Wis.

[21] Appl. No.: 436,577

[22] Filed: Nov. 15, 1989

[30] Foreign Application Priority Data

Mar. 18, 1989 [GB] United Kingdom ..... 890275

[51] Int. Cl.[5] ..... D21F 9/02; D21F 11/04

[52] U.S. Cl. ..... 162/299; 162/123; 162/300

[58] Field of Search ..... 162/299, 300, 301, 303, 162/304, 123

[56] References Cited

U.S. PATENT DOCUMENTS

| | | | |
|---|---|---|---|
| 3,625,814 | 12/1971 | DeNoyer | 162/299 |
| 3,726,758 | 4/1973 | Parker et al. | 162/301 |
| 3,752,734 | 8/1973 | Notbohm | 162/123 |
| 3,856,618 | 12/1974 | Roell | 162/299 |
| 3,951,736 | 4/1976 | Kobayashi | 162/301 |
| 3,997,390 | 12/1976 | Kankaanpaa | 162/303 |
| 4,146,424 | 3/1979 | Justus | 162/199 |
| 4,153,504 | 5/1979 | Justus | 162/301 |
| 4,414,061 | 11/1983 | Trufitt et al. | 162/301 |
| 4,416,730 | 11/1983 | Schiel | 162/299 |
| 4,425,187 | 1/1984 | Armstrong et al. | 162/300 |
| 4,459,175 | 7/1984 | Bubik et al. | 162/300 |
| 4,472,244 | 9/1984 | Haltsonen | 162/300 |
| 4,557,802 | 12/1985 | Waris | 162/264 |
| 4,894,120 | 1/1990 | North | 162/301 |

FOREIGN PATENT DOCUMENTS

| | | | |
|---|---|---|---|
| 2548794 | 4/1977 | Fed. Rep. of Germany | 162/301 |

*Primary Examiner*—Karen M. Hastings

*Attorney, Agent, or Firm*—Dirk J. Veneman; Raymond W. Campbell; Gerald A. Mathews

[57] ABSTRACT

A paper forming apparatus has a lower looped forming wire disposed for a portion of its travel over a curved apron board. The paths of forming wire travel upstream and downstream of the apron board diverge. Such divergence allows a secondary headbox to be brought into such a juxtaposition with the forming wire coming off the apron board as to permit the stock stream to impinge the forming wire both at a low angle and at a short distance to enhance formation of an additional web ply over a previously formed web ply. In one embodiment, an upper looped forming wire is brought into co-running engagement with the lower forming wire over the downwardly extending downstream path of travel. In two-wire embodiments, the turning roll for the upstream end of the upper forming wire is downstream of both the headbox slice and apron board to permit the headbox slice to be positioned close to the lower forming wire and allow the stock stream to be projected downwardly to impinge the lower forming wire at a small angle or a short distance from the slice, or both.

14 Claims, 4 Drawing Sheets

MULTI-PLY WEB FORMER

BACKGROUND OF THE INVENTION

This invention relates to the art of papermaking. More specifically, it relates to an improvement in one or two-wire, multi-ply papermaking forming apparatus wherein a lower looped forming wire is arrayed to have a diverging path of travel immediately downstream of a secondary headbox which projects a stock slurry stream onto the diverging path of forming wire travel. In some embodiments, a second, or upper, looped forming wire comes into co-running engagement with the lower forming wire to provide for the extraction of water from the stock slurry traveling between the co-running forming wires upwardly to within the upper forming wire and downwardly to within the lower forming wire.

Still more specifically, this invention relates to a specific configuration of the lower, or fourdrinier, forming wire relative to a secondary headbox slice opening whereby the lower forming wire is directed downwardly and away from the secondary headbox slice to effect a very low angle of impingement of the stock slurry onto the lower forming wire while simultaneously permitting the impingement of the stock slurry at a short distance from the slice.

Examples of prior art paper forming apparatus which this invention improves upon are illustrated and described in U.S. Pat. No. 4,146,424 (Justus) and 4,414,061 (Trufitt et al). In these patents, as well as in some embodiments of this invention, the formation of at least the first ply of the paper web is initiated at an upstream location on a horizontally traveling forming wire, such as is found in a conventional fourdrinier-type papermaking machine. A structural feature common to both of these prior art arrangements is that due to the need to provide an upper forming wire turning roll to bring the upper forming wire into co-running engagement with the lower forming wire over or before the lower wire turning roll, the headbox for projecting the stock slurry onto the lower forming wire cannot be located closer than slightly upstream of where the upper forming wire comes into co-running engagement with the lower forming wire element, usually a roll, which defines the end of the horizontal travel of the lower forming wire. The result is that the stock stream is deposited onto the horizontal, or non-downwardly diverging, portion of the lower forming wire. While these forming arrangements have their own attributes, they do not permit a headbox to discharge a stock slurry onto the lower forming wire at a low angle and at a short distance from the end of the headbox slice opening.

SUMMARY OF THE INVENTION

This invention obviates the aforementioned deficiencies in the prior two-wire formers of this general type. In addition, this invention provides for the formation of a defect-free "white-top" ply over a base ply on a single forming wire papermaking machine. In this invention, the lower forming wire has a downstream portion which is directed downwardly, or away from, an upstream portion of its travel, and the upper forming wire, in those embodiments having an upper forming wire, is both turned and brought into co-running engagement with the web on the lower forming wire downstream from where the lower forming wire is diverged. In all embodiments, the slice nozzle of the secondary headbox is positioned to direct the stock stream at a very low angle to the lower forming wire. The effect of gravity can be utilized, in some embodiments, by diverging the lower forming wire downwardly immediately downstream of the slice nozzle. The divergence is preferably over a convexly curved apron board. The attitude of the upstream and downstream portions of forming wire travel can be changed such that both the upstream and downstream portion can be directed upwardly, horizontally or downwardly. This permits the headbox slice, from which the aqueous stock slurry jet stream exits, to be positioned both closer to the lower forming wire and to project the stock stream onto the lower forming wire at a very low angle approaching tangency, if desired.

The benefit derived from such a configuration is that the stock stream does not produce a phenomenon called "spotting" which occurs when aqueous droplets and stock particles bounce from the wire due to the force of impact of the impinging jet onto the lower forming wire. Such spotting is deleterious to the formation of the paper web due to the disruption the particles and droplets cause when they both leave the lower forming wire and fall back onto it. This is particularly important when the apparatus is producing a multi-ply web wherein one or more plies are produced upstream of the place where the slice nozzle is projecting the stock slurry onto the lower forming wire immediately prior to where any upper forming wire is brought into co-running engagement with the slurry on the lower forming wire.

This apparatus also permits the efficient production of so-called "white top" which is a multi-ply packaging material having a base ply formed of a cheaper, usually unbleached, pulp stock while the upper ply, which would be produced by the secondary headbox downstream of the primary headbox or, in two-wire embodiments, immediately before the upper forming wire comes into co-running engagement with the lower forming wire, would comprise the more expensive, and printable, bleached white stock. Due to the ability of this invention to lessen spotting, the white top layer of stock, and subsequent web, is either thinner, or contains fewer areas where the base ply could show through, or both.

Accordingly, it is an object of this invention to provide a substantially horizontally disposed, two-wire web forming apparatus having upper and lower forming wires wherein spotting by the headbox discharging the stock slurry onto the lower forming wire is reduced.

Another object of this invention is to provide a two-wire web forming apparatus, having a substantially horizontally disposed lower forming wire, wherein a headbox slice opening is brought into closely spaced adjacency with a portion of the lower forming wire which diverges downwardly downstream, and the upper forming wire is brought into co-running engagement with the web a short distance beyond where the stock stream impinges upon the downwardly diverging downstream portion of the lower forming wire at a small angle thereto and at a short distance from the slice.

Still another object of this invention is to provide a multi-ply web forming apparatus wherein the top ply is formed by projecting a stock stream downwardly onto a downwardly extending lower forming wire such that the angle of impingement of the stock onto the lower forming wire is very low and the distance of the point of stock impingement from the slice nozzle is short.

Yet another object of this invention is to provide a single forming wire, multi-ply web forming apparatus wherein the paths of forming wire travel upstream and downstream of a guide means within the forming wire diverge to permit a secondary headbox in proximity to the guide means to discharge a stock stream jet at a low angle and at a short distance to the forming wire.

Still another object of this invention is to control the lower forming wire vibration in a multi-ply web former near where the stock stream to form the second or subsequent ply is projected over the lower forming wire.

A feature of this invention is bringing the upper forming wire, in a two-wire former, into co-running engagement with the lower forming wire at a location downstream from where the lower forming wire is directed downwardly from an upstream planar path of travel.

These, and other objects, features and advantages of this invention will be more readily apparent to those skilled in the art upon reading the description of the preferred embodiment in conjunction with the attached figures and claims.

IN THE DRAWINGS

FIG. 2 is a side-elevational view of a single, fourdrinier wire embodiment where the portion of the wire upstream of the apron board before the secondary headbox is inclined upwardly and the downstream portion of the wire is declined downwardly.

DESCRIPTION OF THE PREFERRED EMBODIMENT

Figure 1:
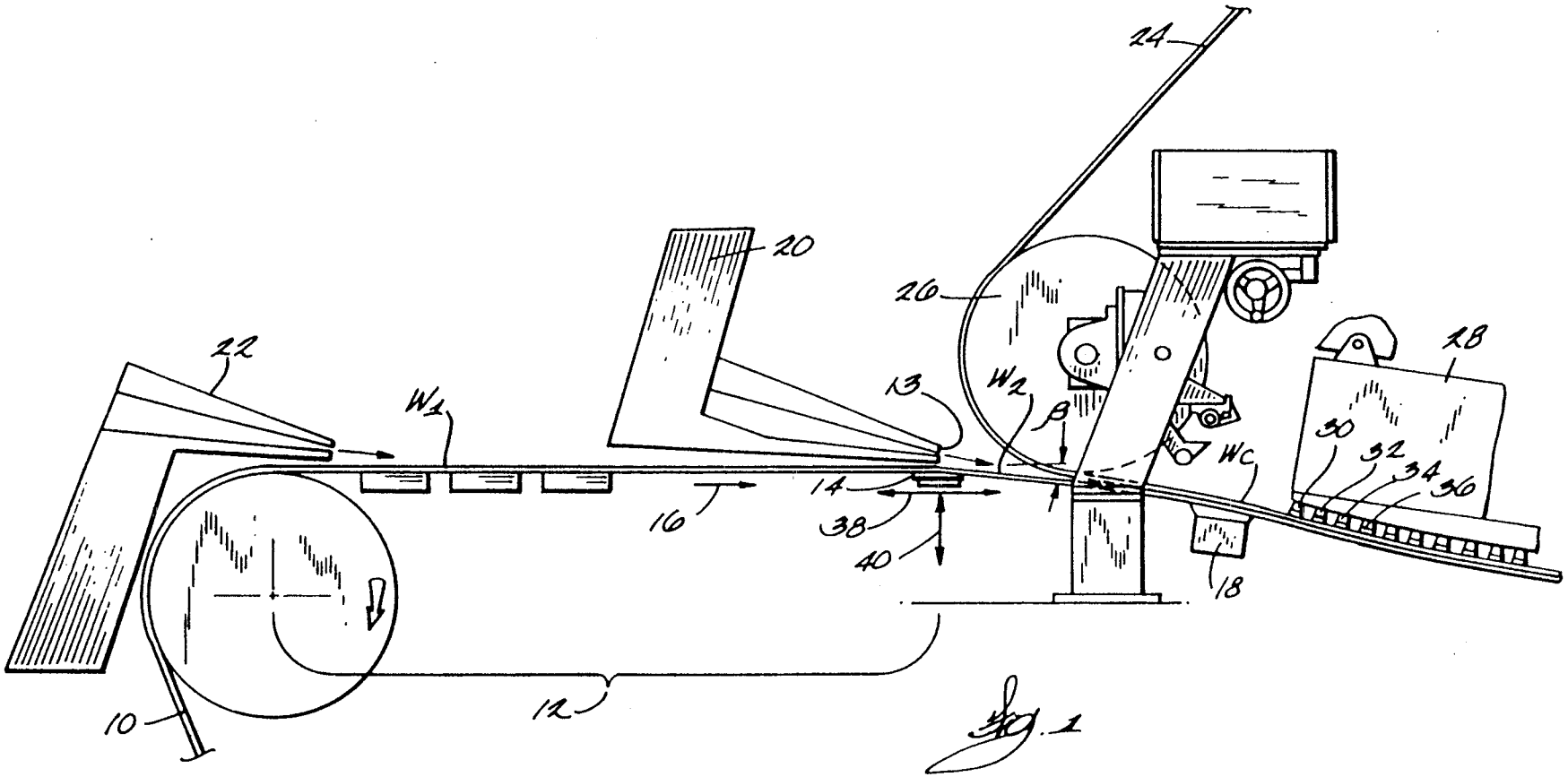
FIG. 1 is a side-elevational view of a two-wire paper forming apparatus which illustrates the deflection of the lower forming wire over an apron board downwardly and away from the stock stream jet emitted from the secondary headbox slice.
Figure 1:
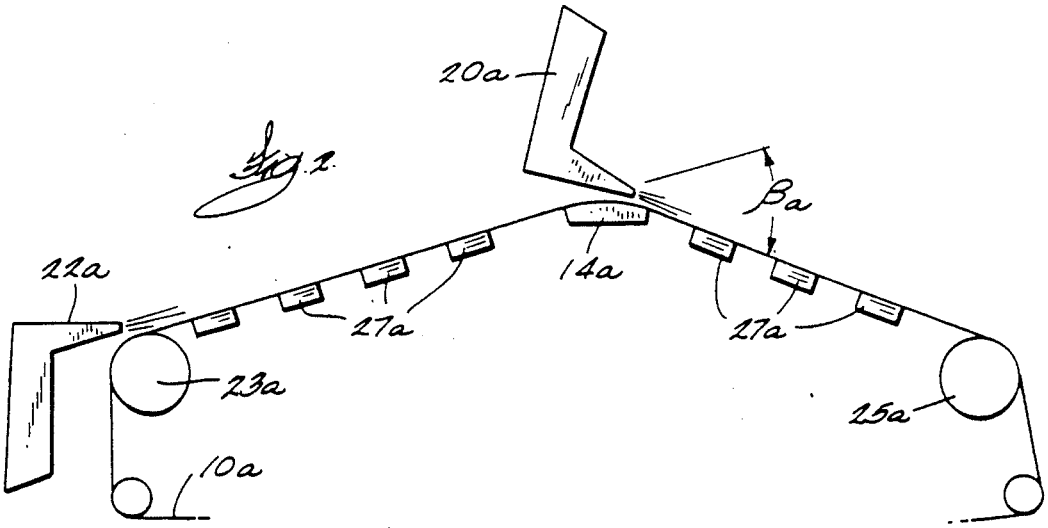

Referring to FIG. 1, the lower forming wire 10, having a planar, substantially horizontally disposed upstream forming zone portion 12 travels over an apron board 14 in the direction of arrow 16 and is turned, or dipped, downwardly at an angle $\beta$ after which it is directed onto the surface of a guide shoe 18. Mounted above the lower forming wire is a secondary headbox 20 producing a second ply on top of a base ply previously formed on the lower forming wire by a base ply headbox 22 which is shown upstream at the beginning of the planar portion forming zone 12 of the lower forming wire in FIG. 1.

In this regard, to the extent necessary, corresponding elements in the various figures are correspondingly designated with alphametric postscripts in different figures.

An upper forming wire 24 in FIG. 1 is turned about a turning roll 26 and brought into closely spaced adjacency with the web $W_c$, which is a composite of initially formed web $W_1$ and newly formed web $W_2$.

The upper and lower forming wires 24, 10 sandwich the web in between and travel over the guide shoe 18 and onto a curved, inverted vacuum box 28 which has a convexly shaped dewatering surface, extending in the downward direction, which is defined by a plurality of blades 30,32,34,36 and continuing, which extend in the cross-machine direction, but which are arrayed to define the convex dewatering surface in the machine direction. A source of sub-atmospheric pressure, such as a vacuum pump (not shown) is operatively connected to the curved, inverted vacuum box to provide sub-atmospheric pressure thereto to urge water upwardly out of the upper forming wire and out of the apparatus.

Figure 5:
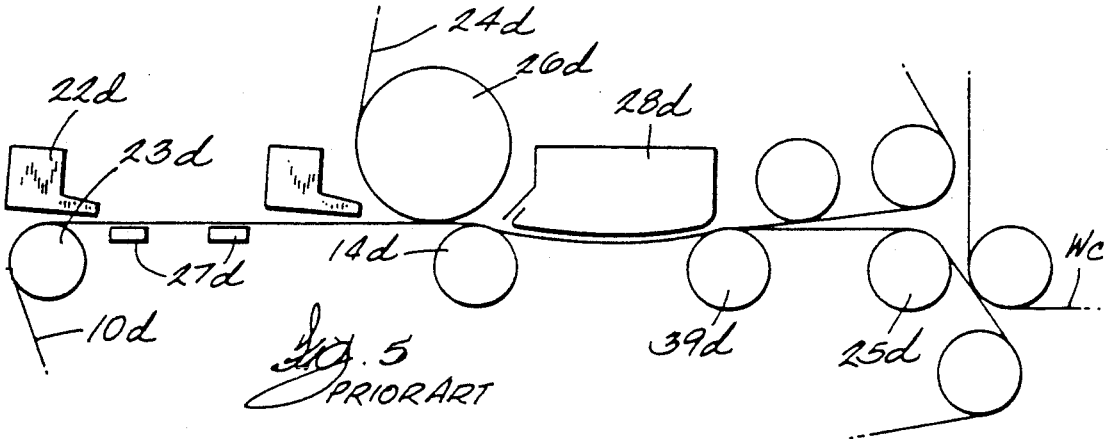
Fig. 5 PRIOR ART
FIG. 5 illustrates the prior art configuration of substantially horizontally disposed two-wire paper forming apparatus of this general type.

As shown in FIG. 5, in prior apparatus of this general two-wire web forming type, the top wire turning roll **26*d* brought the top wire into co-running engagement with the web, or webs, formed on the lower forming wire at a point either upstream of, or at, the point where both horizontally traveling forming wires turned over guide roll 14*d* and were directed downwardly over the curved inverted vacuum box 28*d* where additional dewatering and formation of the web occurred. The stock stream emitted from headbox 20*d* impinged upon the lower forming wire at a relatively large angle, such as greater than about 7°, and at a relatively long distance, such as greater than about 75 mm, from the headbox slice opening, due to the fact that the headbox had to be mounted a certain distance above the horizontally disposed lower forming wire and the stock stream jet projected a certain distance from the slice opening, according to the laws of physics, and also had to be projected horizontally in order to provide relatively gentle impingement commensurate with the volume of stock necessary to produce a web having a specified caliper. In other words, any problems associated with spotting, or other disruptions of the stock stream jet impinging upon the lower wire 10*d***, could only be alleviated by reducing the pressure behind the stock stream jet, or reducing the volume of stock flow through the headbox, or both. However, in order to produce a paper product at high speeds and competitively, these alternatives were simply not attractive.

Referring again to FIG. 1, the top wire turning roll 26 is located downstream of an apron board 14 which, itself, is adjustable both longitudinally in the machine direction as shown by double-headed arrow 38, and normally to the plane of the lower forming wire as shown by double-headed arrow 40. In addition, the upper turning roll 26 is mounted to bring the upper forming wire downwardly to a point where it is at, or below, the plane of the upstream portion 12 of the lower forming wire 10. The downward divergence, or dipping, of the lower, or fourdrinier, forming wire 10 downstream of apron board 14 in combination with the location of the turning roll 26 downstream of apron board 14 permit the slice 13 of secondary headbox 20 to be positioned closer to the lower forming wire and to project its stock stream at a small angle relative to fourdrinier wire 10 as will be explained in more detail subsequently. Guide shoe 18 is also positioned beneath the plane of the upstream portion 12 of the lower forming wire so as to guide both upper and lower forming wires 10,24 downwardly, the lower forming wire from the trailing portion of the curved apron board 14 and the upper forming wire from the lower periphery of turning roll 26. This downwardly directed path of travel of the downstream portion of the lower forming wire relative to the upstream portion thereof is designated by the wire angle $\beta$.

In the embodiment shown in FIG. 2, a single, lower forming wire **10*a* is utilized in conjunction with a primary headbox 22*a* and a secondary headbox 20*a*. The portion of the lower, or fourdrinier, wire 10*a* upstream of headbox 20*a* is inclined upwardly from the horizontal at an angle, while the portion of the forming wire downstream from forming board 14*a* diverges downwardly from the upstream portion at a wire angle $\beta^a$. The impingement angle in this invention relates to the angle $\alpha$ of the stock stream emitted from the slice of the secondary headbox relative to the lower, or fourdrinier, forming wire. This impingement angle will be discussed in more detail in conjunction with FIGS. 6A, 6B and 6C. The forming wire travels upwardly from the breast roll 23*a* to the apron board 14*a* where it is turned to travel downwardly and guided over couch roll 25*a*. A plurality of dewatering elements 27, such as foil boxes, are disposed beneath the forming wire intermediate the breast roll 23*a* and apron board 14*a* and the apron board and the couch roll 25*a*, respectively. Angle $\beta$ designates the wire angle in which a plane coincident with the forming wire 10*a* downstream of the apron board 14*a* declines from a plane coincident with the forming wire upstream of the apron board 14*a*. The secondary headbox 20*a* is then positioned to direct its stock stream jet at a very low angle, approaching tangency, of the downstream portion of the forming wire extending downwardly from the trailing side of apron board 14*a***.

Figure 3:
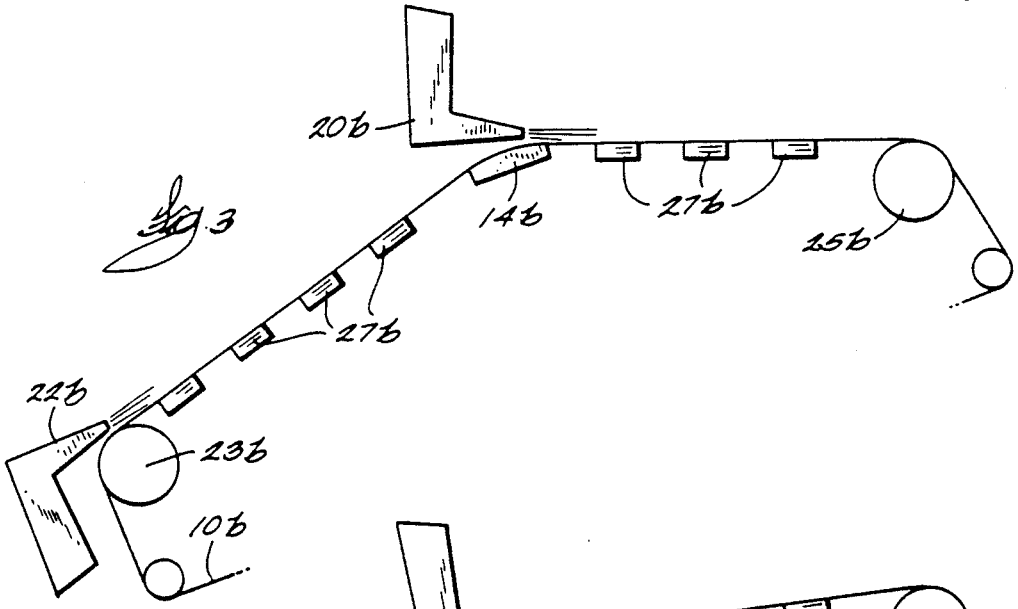
FIG. 3 is a side-elevational view of a single, fourdrinier wire embodiment, similar to that shown in FIG. 2, wherein the forming wire downstream of the secondary headbox and over the forming board is deflected downwardly relative to the upstream portion and is disposed horizontally.
Figure 4:
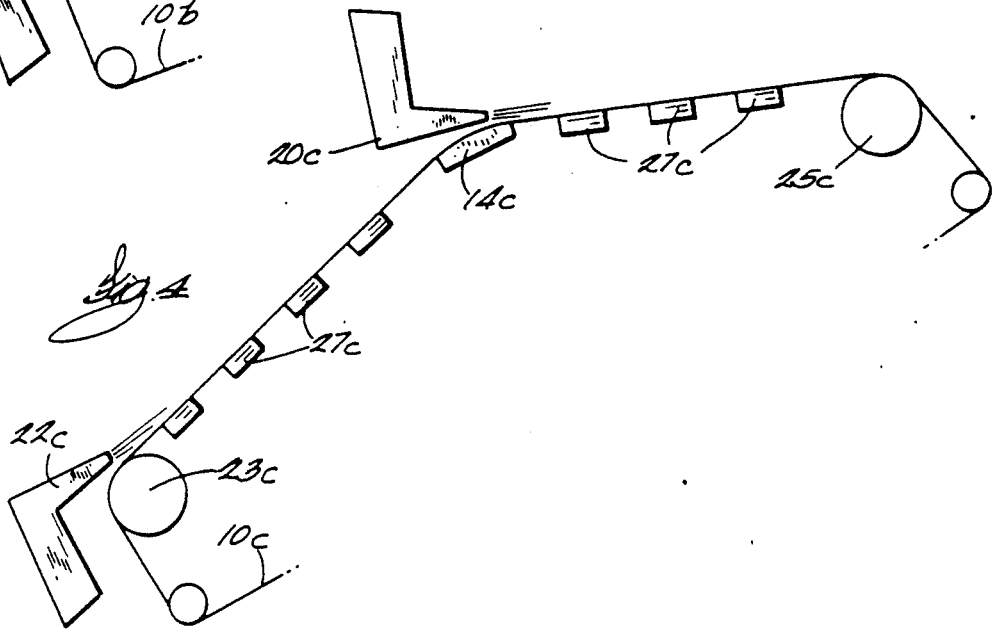
FIG. 4 is a side-elevational view of another embodiment similar to the embodiments shown in FIGS. 2 and 3, but wherein the portion of the forming wire extending downstream of the forming board extends upwardly.

FIGS. 3 and 4 also illustrate an embodiment for producing a multi-ply web on a single wire, fourdrinier-type papermaking machine wherein the base ply is produced by a headbox **22*b*, 22*c* at the beginning of the upstream end of the forming zone of the fourdrinier wire. In both these embodiments, the portion of the forming wire upstream of the curved apron board 14*b*, 14*c* is sloped upwardly in the direction of forming wire travel. Secondary headboxes 20*b*,20*c* are disposed in proximity over the forming wire and base web ply thereon as they pass over the apron board 14*b*, 14*c*. In the embodiment shown in FIG. 3, the portion of forming wire travel downstream of apron board 14*b* is essentially horizontal. In FIG. 4, the portion of forming wire travel downstream of apron board 14*c* is slightly upwardly directed, but at a lesser angle than the portion of the forming wire upstream of apron board 14*c***.

In both these configurations shown in FIGS. 3 and 4, the fourdrinier, or forming, wires **10*b*, 10*c* are guided over breast rolls 23*b*, 23*c* and pass over dewatering devices 27*b*, 27*c* which typically comprise a plurality of blades or foils which may or may not be grouped in an enclosed support structure which may or may not utilize vacuum pressure to promote faster dewatering through the forming wire. At the downstream end of the forming run, the forming wire turns over a couch roll 25*b*, 25*c* for the return run past the primary headbox 22*b*, 22*c***.

In both these embodiments, the secondary headbox **20*b*, 20*c*** deposits is stream of stock, such as the more expensive, more easily printable, bleached white stock, onto the previously formed base ply at a very low angle of impingement, which will be discussed in more detail subsequently.

Figure 6A:
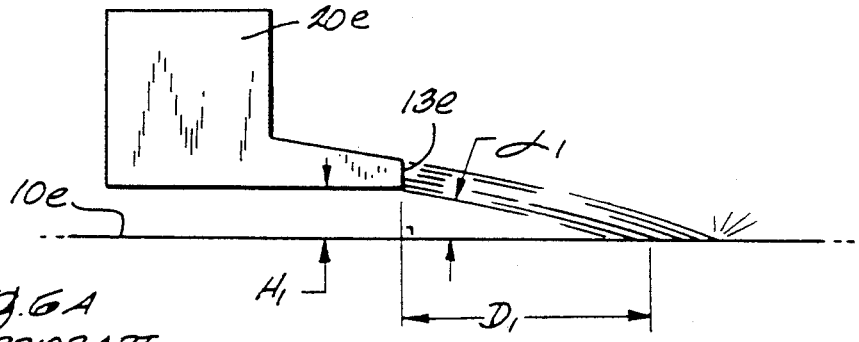
Fig. 6A PRIOR ART
FIG. 6A and 6B are a side-elevational views of the configuration of the stock stream jet impinging upon a horizontally disposed lower forming wire (FIG. 6A) and a downwardly disposed lower forming wire (FIG. 6B) and more clearly illustrates the angles and distances of the stock stream relative to the headbox slice opening and lower forming wire.
Figure 6B:
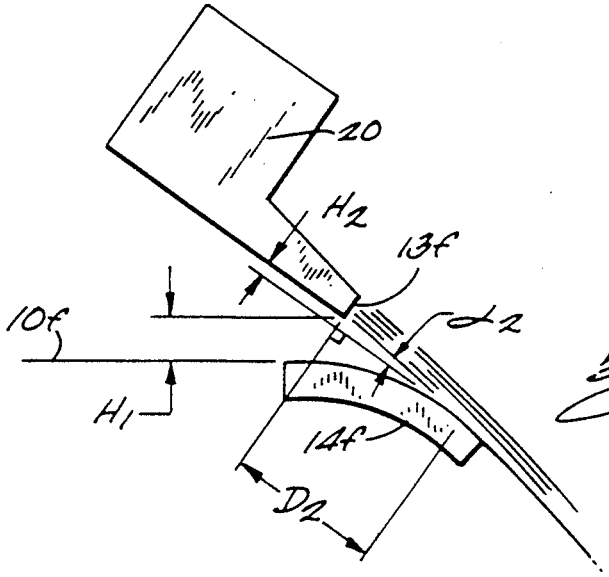
Figure 6C:
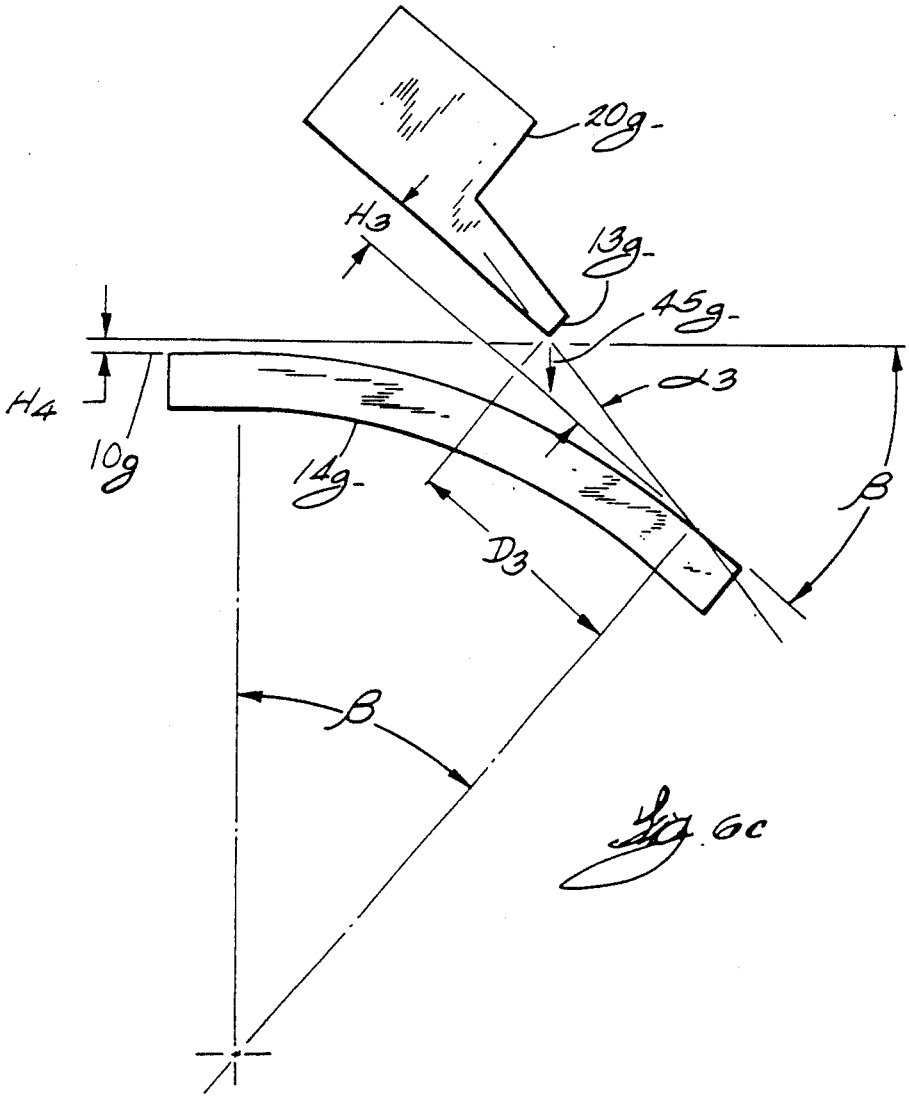
FIG. 6C is a side-elevational view similar to FIG. 6B, but more clearly showing the angle of stock impingement and wire turning angle with the headbox slice positioned in a preferred downstream location.

FIGS. 6A, 6B and 6C are generic to the secondary headbox **20*e* and 20*f* relative to the lower forming wire in the prior art configuration shown in FIG. 5 (FIG. 6A) and in this invention (FIGS. 6B, 6C), respectively. Thus, the ratio $H_1/D_1$ designates the angle of impingement of the stock stream emitted from the headbox slice onto the substantially horizontally-disposed lower, or fourdrinier wire in the prior art type of arrangements, and the ratio $H_2/D_2$ represents the angle of impingement of the stock jet emitting from the headbox slice in the configuration of this invention. The designation H represents the perpendicular height of the lower lip of the headbox slice from either the plane of the lower forming wire or, in the embodiment of the invention shown in FIGS. 6B and 6C, the perpendicular height of the lower lip of the headbox slice opening from a plane tangent to the lower forming wire at the closest point of impingement of the stock stream onto the lower forming wire. The designation D is the lateral distance from the headbox slice to the closest point of stock stream impingement on the forming wire. If the lower forming wire is planar at the point of impingement, the plane from which H is measured is coincident with the forming wire and distance D is parallel with this plane. If the lower forming wire is curved, the distance D is parallel to a plane tangent to the wire at the point of stock stream impingement. Thus, it is seen that the angle of impingement $\alpha$ for the prior art top ply forming arrangement shown in FIG. 5 is greater than the angle of impingement $\alpha$ for the apparatus of this invention shown in FIGS. 6B and 6C due to the fact that, in the embodiment shown in FIG. 5**, the height of the headbox $H_1$ above the forming wire can't be decreased beyond a certain distance in order to accommodate the structure necessary to support the headbox slice.

In FIG. 6B, the distance $H_1$ is the same as the distance $H_1$ in the prior art configuration shown in FIG. 6A in order to make the comparison of the angle of impingement between the two generic embodiments shown in FIGS. 6A and 6B more meaningful.

Also noteworthy in the comparison between the prior art arrangement shown in FIG. 6A and the generic arrangement of the headbox slice opening of this invention as shown in FIG. 6B is that the distance $D_1$ from the slice lip to the nearest point of stock impingement upon the lower forming wire, as measured parallel to the lower forming wire, is greater than the distance $D_2$ which is the distance from the headbox slice to the nearest point of stock stream impingement against the lower forming wire in a direction parallel to a plane tangent to, or coincident with, the forming wire at this point of stock impingement.

Thus, it is seen that the arrangement of this invention shown in FIG. 6B provides both a smaller angle of impingement of the stock stream against the lower forming wire as well as permitting the stock stream to impinge upon the lower forming wire at a shorter distance from the headbox slice than the prior art type of arrangement shown in FIG. 6A. In this regard, values for the angle of impingement $\alpha$ in this invention range from 0° to about 6°, preferably from about 0° to about 3°. Similarly, values for the distance of stock impingement on the forming wire from the headbox slice opening range from about 10 mm up to about 75 mm, preferably from about 30 mm to about 75 mm.

Since the angle of impingement $\alpha_2$ is the arc tangent of $H_2/D_2$, the value, or range, of $H_2$ is important also. It is desired to make $H_2$ as small as possible. By dipping the lower, or fourdrinier, forming wire downwardly downstream of the apron board 14*f*, the distance $H_2$ can be made quite small. Accordingly, the value of $H_2$ preferably ranges from about 0 to about 12 mm. What is important is that the actual values from $H_2$ and $D_2$ in a given situation are selected to provide the desired angle of impingement within the range of between about 0°–6°.

In the apparatus of this invention, the headbox can be tilted upwardly, although this is not absolutely necessary, as shown in FIG. 3, so the stock stream jet forms an angle with the downstream diverging portion of the lower forming wire and impinges upon the lower forming wire at a distance $D_2$. Although the figures are exaggerated for purposes of comparison, it is clear that angle $\alpha_2$ is less than angle $\alpha_1$ and distance $D_2$ is less than distance $D_1$.

The design of this apparatus is such that both angle $\alpha_2$ and distance $D_2$ need not be less than the corresponding angle $\alpha_1$ or distance $D_1$ of the prior art configuration shown in FIG. 6A. The particular operating conditions of machine speed, stock consistency, desired caliper of the web being formed and other factors may result in only one, or possibly two, of these parameters being less than the corresponding parameter of the prior art configuration. The important aspect of this invention is that the angle of impingement $\alpha$, distance H and the distance D of impingement of the stock stream jet from the slice can be controlled and minimized, as desired. These values and relationships of $\alpha$, H and D are both made feasible and optimized by virtue of the unique combination of the divergence of the portion of the forming wire downstream of the apron board relative to the portion of the forming wire upstream of the forming board in conjunction with the positioning of the headbox slice proximate to the forming board at the beginning of the downstream divergence of the forming wire. This divergence is defined by wire angle $\beta$.

In all embodiments of this invention, the forming board 14 is convexly curved with its convex surface disposed within the looped lower, or fourdrinier, wire to direct the lower wire downwardly in a corresponding convex curve, as viewed from outside the looped lower forming wire. The magnitude of angle $\beta$ designating the downwardly directed deflection of the lower forming wire from the plane of the lower forming wire upstream of the forming board is not critical. It generally is about 8°, or greater. Its significance lies in the fact that the lower forming wire does extend downwardly at that point and permits the headbox to project the stock stream at a very low angle relative to the plane of this downstream segment of the forming wire. Additional significance resides in the ability to locate the headbox slice downwardly over the divergence such that the stock stream exits the slice much closer to the plane of the forming wire immediately upstream of the slice and much closer to the point where it contacts the base ply web on the forming wire.

FIG. 6C illustrates the advantageous combination of the downwardly deflecting lower forming wire 10*g* and the downwardly directed headbox 20*g* directing the stock stream from its slice at a slice location which is at a very short distance $H_4$ from the upstream plane of the lower forming wire. The wire angle $\beta$ extends from a plane normal to the plane of the upstream portion of lower forming wire 10*g* to a plane normal to the plane of the downstream portion of the lower forming wire which is downstream of the apron board 14*g*. This wire angle $\beta$ is shown in two locations for purposes of clarity and understanding the invention. The angle of impingement $\alpha$ is shown between the plane tangent to the downstream portion of the lower forming wire at the point where the stock stream impinges the forming wire (actually, where it impinges the base ply web on the forming wire) and a plane extending through the point of tangency and the lower opening of the slice. In this FIG. 6C, the plane tangent to the point of stock impingement is coincident with the planar portion of the downstream forming wire shown.

FIG. 6C also illustrates how the headbox slice opening can be lowered, in the direction of arrow 45*g*, over the downwardly directed lower forming wire to make the distance $H_4$ from the planar, upstream portion of the lower forming wire 10*g* very small, zero, or even below the planar upstream portion of the lower forming wire. Such movement would have the concomitant effect of decreasing the impingement angle $\alpha$ so that it would approach, or equal, 0°, if desired. In other words, tan $\alpha_3 = H_3/D_3$ and this angle decreases as the headbox slice moves downwardly in the direction of arrow 45*g*. In FIG. 6C, the values of $H_3$, $D_3$, $H_4$, and $\alpha_3$ and $\beta$ are shown as being relatively large for purposes of illustration so they are not to scale. The configuration of this invention as shown in FIG. 6C permits the lowering of the headbox slice to a minimum distance $H_3$ from the plane of the downwardly extending portion of the lower forming wire.

Figure 7:
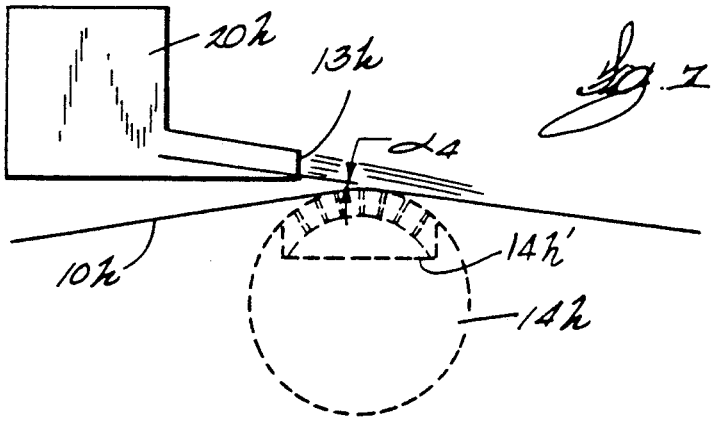
FIG. 7 is a side-elevational view similar to FIG. 6, but showing how the forming wire could be turned over a roll, and showing the impingement angle of the stock stream relative to the plane of the forming wire.

Naturally, various modifications can be made without departing from the spirit and scope of the invention. For example, a stationary curved blade box, or a curved foraminous cover or a rotating roll, which could have a foraminous roll shell, and all of which could be connected to a source of vacuum pressure to promote removal of water through the forming wire, could be substituted for the stationary apron board to guide the lower, or fourdrinier, wire downwardly downstream relative to a substantially planar upstream portion. Such a variation is shown in FIG. 7 wherein a superposed breast roll 14*h* and curved foraminous cover 14*h'* have been substituted for the apron board. The lower forming wire 10*h* is also shown dipped downwardly in a single wire multi-ply configuration wherein the secondary headbox 20*h* can project the stock stream at such a flat angle that $\alpha_4$ is zero. The dashed line shows the extension of the plane of the portion of forming wire downstream of roll 14*h*. Similarly, the apron board can take the form of a vacuum box 14h' with a convex surface.

Finally, the embodiments shown illustrate the forming zones upstream and downstream of apron board 14 as being substantially planar with the exception of the downstream forming zone portion in FIG. 1. This was for the purpose of illustrating the invention in a typical fourdrinier-type of forming arrangement. It is contemplated that either or both of the upstream and downstream forming paths of travel, relative to the apron board or roll 14, can also be curved.

What is claimed is:

1. In a multi-ply paper web forming apparatus having a first looped fourdrinier forming wire disposed to travel in a substantially horizontal forming zone downstream of a primary headbox for emitting a stock slurry jet onto the first forming wire only to form a base ply paper web thereon, and a secondary headbox having a slice opening for emitting a stock slurry jet onto the first forming wire downstream of the primary headbox to form a second ply paper web over the base ply, the combination comprising:

a means for guiding mounted and downstream portions of the first forming wire relative thereto, said means for guiding disposed to define the beginning of a planar, substantially horizontally disposed diverging path of travel of the first forming wire downstream of the secondary headbox;

the secondary headbox is disposed with its slice opening in spaced adjacency with the first forming wire over the means for guiding downstream of the beginning of the diverging path of travel;

said apparatus being structured and arranged so that the stock jet emitted from the secondary headbox slice impinges upon the base ply web on the diverging path of travel of the first forming wire at a low impingement angle of from about 0° to about 6° relative to the portion of the first forming wire downstream of the means for guiding and a short distance ranging up to about 75 mm from the secondary headbox slice opening.

2. A multi-ply paper web forming apparatus as set forth in claim 1, wherein:

the means for guiding has a convex surface disposed toward the first looped forming wire.

3. A multi-ply paper web forming apparatus as set forth in claim 1, wherein:

the height of the secondary headbox slice above the first forming wire, or a planar extension thereof coincident with or tangent to at the point of stock impingement, is from about 0 mm to about 12 mm.

4. A multi-ply paper web forming apparatus as set forth in claim 1, wherein:

the secondary headbox slice is positioned below the upstream portion of the first forming wire or a planar extension thereof at the point of the beginning of forming wire divergence.

5. A multi-ply paper web forming apparatus as set forth in claim 1, wherein:

the divergence of the downstream portion of the first forming wire is at a wire angle of at least about 8°.

6. A multi-ply paper web forming apparatus as set forth in claim 1, wherein:

the impingement angle ranges from about 0° to about 3°.

7. A multi-ply paper web forming apparatus as set forth in claim 1, further including:

upper guide means, including an upper turning roll positioned downstream of the means for guiding;

an upper looped forming wire disposed to travel in co-running, opposed array with the first forming wire during a portion of their travel, said upper turning roll guiding the upper forming wire into co-running travel with the first forming wire downstream of the beginning of the means for guiding.

8. An apparatus for forming a multi-ply web from a fibrous slurry of stock comprising, in combination:

a looped substantially horizontal fourdrinier wire;

a primary headbox for depositing a stock stream on the fourdrinier wire only to form a base ply web thereon;

means for dewatering the base ply web through the fourdrinier wire;

means for guiding the fourdrinier wire mounted within the looped fourdrinier wire;

means defining, in conjunction with the means for guiding the fourdrinier wire, an upstream portion of the fourdrinier wire relative to the means for guiding the fourdrinier wire;

means defining, in conjunction with the means for guiding the fourdrinier wire, a planar, substantially horizontally disposed downstream portion of the fourdrinier wire which diverges away at an angle from the upstream portion of the fourdrinier wire;

a secondary headbox with its slice disposed downstream of the beginning of the diverging path of travel to project a secondary stock stream onto the base ply web over the diverging portion of the fourdrinier wire;

said apparatus being structured and arranged so that the secondary stock stream impinges upon the diverging portion of the base ply web at a small impingement angle of about 0° to about 6° to effect a minimum of spotting of the secondary stock while producing a uniform top ply web upon the base ply to form a composite web.

9. A multi-ply paper web forming apparatus as set forth in claim 8, further including:

a looped upper forming wire disposed to travel in co-running, opposed array with the fourdrinier wire during a portion of their travel;

wire turning means disposed within the upper forming wire, and downstream of the means for guiding, for bringing the upper forming wire into engagement with the secondary stock stream over the base ply web downstream of the means for guiding.

10. A multi-ply paper web forming apparatus as set forth in claim 8, wherein:

said apparatus is structured and arranged such that the lateral distance of the stock stream from the secondary headbox slice to the point of its impingement on the first coming wire is from about 30 mm to about 75 mm.

11. A multi-ply paper web forming apparatus as set forth in claim 8, wherein:

the height of the secondary headbox slice above the first forming wire, or a planar extension thereof coincident with or tangent thereto at the point of stock impingement, is from about 0 mm to about 12 mm.

12. In a multi-ply paper web forming apparatus having a first looped forming wire disposed to travel in a substantially horizontally disposed forming zone downstream of a primary headbox for emitting a stock slurry jet onto only the first forming wire to form a base ply paper web thereon, and a secondary headbox having a slice opening for emitting a stock slurry jet onto the first forming wire downstream of the primary headbox to form a second ply paper web over the base ply, the combination comprising:

an apron board mounted within the first forming wire and disposed to define the beginning of a planar, substantially horizontally disposed diverging path of travel of the first forming wire downstream of the secondary headbox;

the secondary headbox is disposed with its slice opening in spaced adjacency with the first forming wire over the apron board downstream of the beginning of the diverging path of travel;

said apparatus being structured and arranged so that the stock jet emitted from the secondary headbox slice impinges upon the base ply web on the diverging path of travel of the first forming wire at a low impingement angle of from about 0° to about 6° such that the height of the secondary headbox slice above the first forming wire, or a planar extension thereof coincident with or tangent thereto at the point of stock impingement, is from about 0 mm to about 12 mm, the lateral distance of the stock stream from the secondary headbox slice to the point of its impingement on the first forming wire is from about 30 mm to about 75 mm.

13. A multi-ply paper web forming apparatus as set forth in claim 12, further including:

an upper looped forming wire disposed to travel in co-running, opposed array with the first forming wire during a portion of their travel, said upper forming wire coming into co-running travel with the first forming wire downstream of the beginning of the first forming wire divergence over the apron board.

14. A multi-ply paper web forming apparatus as set forth in claim 13, wherein:

said apparatus is structured and arranged such that the angle of impingement of the stock emerging from the secondary headbox slice ranges from about 0° to about 3+ relative to the portion of the first forming wire downstream of the apron board.

* * * * *

UNITED STATES PATENT AND TRADEMARK OFFICE

CERTIFICATE OF CORRECTION

PATENT NO. : 5,064,502

DATED : 11/12/91

INVENTOR(S) : James A. Turner

It is certified that error appears in the above-identified patent and that said Letters Patent is hereby corrected as shown below:

| | |
|---|---|
| Column 9, Line 23: | add --within the first forming wire and defining upstream-- after "mounted". |
| Column 9, Line 60: | delete "downstream". |
| Column 9, Line 61: | add "downstream" after first occurrence of wire. |
| Column 12, Line 20: | "3+" should read --3°--. |

Signed and Sealed this

Twenty-third Day of March, 1993

*Attest:*

STEPHEN G. KUNIN

*Attesting Officer*

*Acting Commissioner of Patents and Trademarks*